United States Patent [19]

Goolsby et al.

[11] Patent Number: 4,605,580

[45] Date of Patent: Aug. 12, 1986

[54] PILE FABRIC FORMED FROM FABRIC STRIPS

[75] Inventors: Thomas C. Goolsby, Dalton; Dock Sanford, Ellijay, both of Ga.

[73] Assignee: Cannon Rug Company, Dalton, Ga.

[21] Appl. No.: 768,860

[22] Filed: Aug. 23, 1985

[51] Int. Cl.[4] ..... B32B 3/02; B32B 33/00

[52] U.S. Cl. ..... 428/92; 156/72; 428/93; 428/94

[58] Field of Search ..... 428/92, 93, 94, 17; 156/72

[56] References Cited

U.S. PATENT DOCUMENTS 1,999,044 4/1935 Frank ..... 139/402

*Primary Examiner*—Marion C. McCamish

*Attorney, Agent, or Firm*—Bell, Seltzer, Park & Gibson

[57] ABSTRACT

A tufted fabric suitable for use as a throw rug or carpet is formed having a unique and appealing visual appearance and a lush, rich texture. The pile fabric is characterized in that the pile portion is formed from fabric strips, such as strips of woven fabric, which extend from a backing fabric. The strips may be of a uniform color throughout the fabric or may be of different colors to form a multi-color appearance. The fabric strips may also contain printed patterns thereon which present unique pattern effects in the pile fabric.

11 Claims, 6 Drawing Figures

PILE FABRIC FORMED FROM FABRIC STRIPS

This invention relates to a pile fabric having a unique appearance and texture and wherein the pile of the fabric is formed from fabric strips.

In accordance with the present invention, a pile fabric suitable for use as a throw rug or carpet is formed having a unique and appealing visual appearance and lush, rich texture, and which is characterized in that the pile portion of the rug is formed from fabric strips which extend from a backing fabric. The strips, which may suitably be of a woven textile fabric, may be of uniform color throughout the fabric or may be of different colors to form a multi-color appearance in the rug or carpet. The fabric strips may also contain printed patterns thereon which present a unique and appealing pattern effects in the rug.

The pile fabric is formed by producing strips of fabric, forming the fabric strips into a condensed, twisted strand-like form, and then forming the condensed strands into a pile fabric by suitable means, such as by tufting with a conventional tufting machine. In the preferred embodiment, the pile tufts are cut so that the end portions tend to unfurl from the condensed, twisted form and resume their flat strip-like configuration while the bases of the tufts remain in a condensed form.

Some of the features and advantages of the invention having been stated, others will become apparent as the description proceeds when taken in connection with the accompanying drawings, in which FIG. 1 is a perspective view of a rug in accordance with the present invention;

Figure 1:
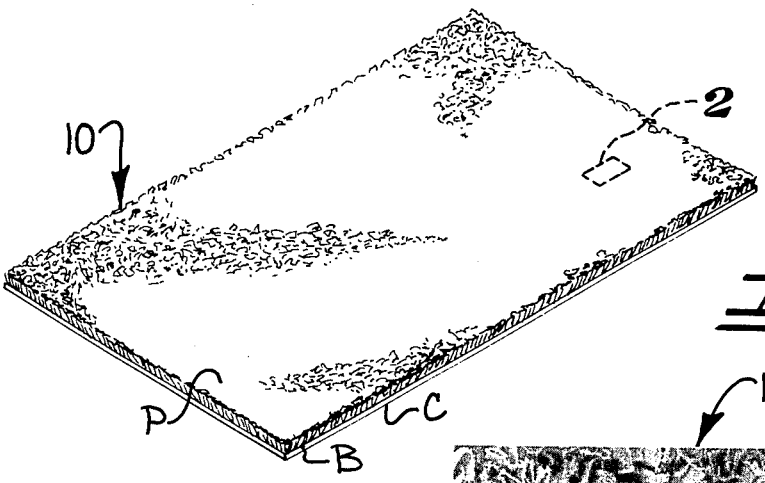
Figure 2:
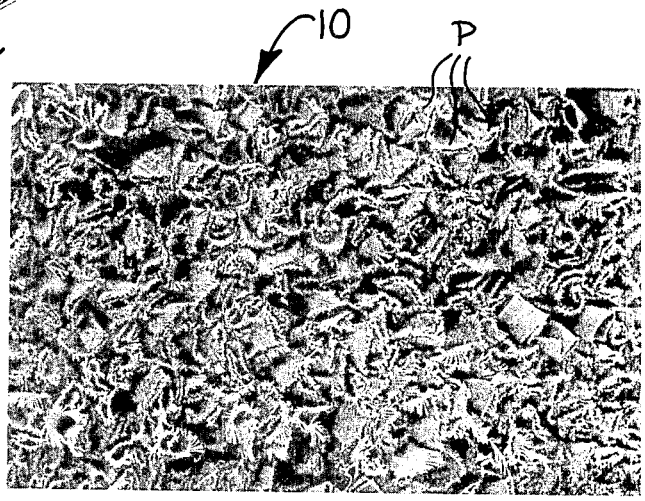
FIG. 2 is a photographic illustration of a small portion of the surface of the rug as indicated at 2 in FIG. 1.

Referring now more particularly to the FIGS. 1 and 2, the reference character 10 generally indicates a pile fabric produced in accordance with the present invention. As illustrated, the pile fabric includes a backing B and a pile surface P on one face of the backing.

Figure 3:
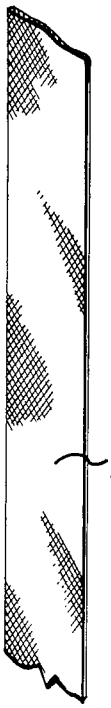
FIG. 3 is a perspective view illustrating a fabric strip from which the rug is formed.

The pile surface P is formed from strips 11 (FIG. 3) of fabric. The fabric strips 11 have a width considerably greater than their thickness, and may suitably range in width from about one-fourth inch to about one and one and one-fourth inches and preferably about one-half to one and one-fourth inches. In the embodiment illustrated, the strips 11 are formed from a woven fabric, but fabrics of various other constructions, such as nonwoven fabrics and knitted fabrics, could also be used. When woven fabric is used, the strips may be formed of a narrow woven fabric or tape, or the strips may be cut from a wider woven fabric. When cut strips are used, they are preferably cut on the bias so that the warp and weft direction of the fabric extends at an acute angle with respect to the length direction of the strips. Once the strips 11 have been cut, they may be secured together end-to-end in a suitable manner such as by a knot, or by sewing or glueing to produce a continuous strip of the desired length.

Figure 4:
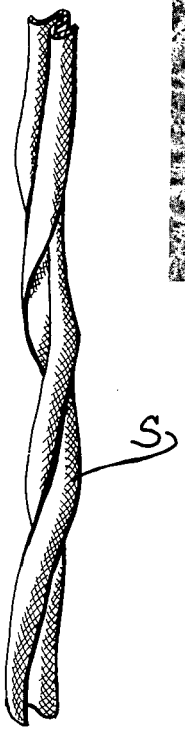
FIG. 4 is a view illustrating the fabric strip when twisted into a rope-like configuration to form a continuous strand suitable for tufting.

In order to facilitate processing into a pile fabric, the strip is formed into a condensed strand form S such as is illustrated in FIG. 4. This may be suitably accomplished by folding, doubling, twisting or bunching the strip. For example, the strip may be processed on a conventional twisting machine and given a light twist (e.g. about one half to 3 tpi) to form a lightly compressed, condensed strand of the configuration illustrated in FIG. 4.

Figure 5:
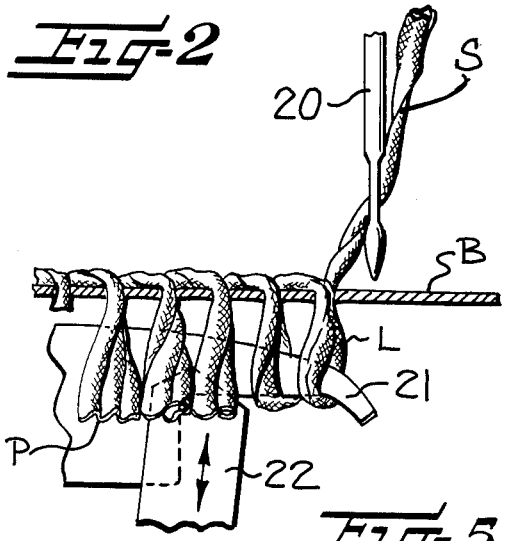
FIG. 5 is a schematic illustration of how the strand is tufted into a backing fabric to form the rug.

In this condensed, rope-like form, the strand S can be handled in a manner similar to any conventional carpet yarn and can be processed on conventional machinery to form the fabric strips into a pile fabric. Tufting is the preferred method of pile fabric formation in accordance with the invention, although similar pile fabric effects could be achieved by other manufacturing methods, such as by weaving or knitting, for example. A conventional shag tufting machine such as is illustrated schematically in FIG. 5 may be suitably employed to form the fabric strips into a pile fabric wherein the fabric strips extend in rows widthwise of a backing and along the length thereof and form a pile surface on one face of the backing. As is well known, a tufting machine includes a needle bar with a plurality of tufting needles 20 which penetrate the backing fabric B at spaced locations across the width of the backing and force the strand through the backing. Cooperating loopers 21 on the opposite side of the backing engage the strand S and form tuft loops L. The loops may be left intact, or as illustrated, may be thereafter cut with a suitable cutter arrangement such as the cutter 22 illustrated. It will be seen that once the loop L is cut, the free end portions of the tufts tend to unfurl and open up and resume their strip-like configuration, while the base portion where the strip penetrates the backing remains in a bunched, compressed, rope-like strand form. The density and height of the pile on the backing may be varied as desired.

Figure 6:
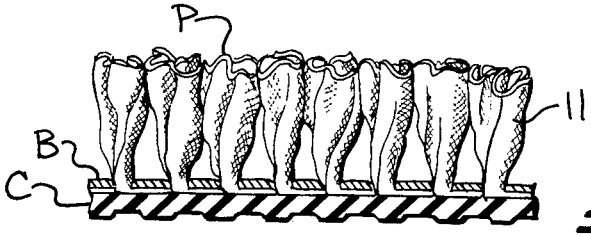
FIG. 6 is a cross sectional view of a portion of the rug.

After tufting, the back surface of the pile fabric may be coated with a coating composition to secure the tufts to the backing, and/or a cushion layer (indicated at C in FIG. 6) formed of a resilient composition may be applied to the backing.

The rug construction of this invention and its method of manufacture make possible an endless variety of design and appearance variations. For example, an entire rug or carpet can be formed from predyed strips of a uniform color throughout to form a uniformly colored rug. Alternatively, different colored strands can be employed across the width of the tufting machine to produce a rug having multi-color stripes in the machine direction. Different colored strips of fabric can be tied or otherwise secured together during the formation of the strands to additionally produce multi-color variations along the machine direction. It is also possible to produce the entire rug from undyed fabric and to dye the rug after formation. Other unique appearance effects can be achieved by forming the rug from fabric which has been printed with various patterns and colors. It is also possible to use different types of fabric in different areas of the rug to achieve variations in texture in different areas of the rug. From the foregoing brief description, a person skilled in the art will appreciate the wide variety and endless variation that can be achieved in rugs or carpets produced in accordance with the present invention.

In the drawings and specification there has been set forth a preferred embodiment of the invention, and although specific terms have been employed, they are used in a generic sense only and not for purposes of limitation.

That which is claimed is:

1. A tufted pile fabric comprising a backing and a plurality of fabric strips tufted into said backing and forming a pile surface on one face of said backing, said fabric strips each including a base portion of condensed strand configuration penetrating the backing and an upstanding cut pile tuft portion extending from said one face of said backing of uncondensed strip-like configuration.

2. A pile fabric comprising a backing and a plurality of fabric strips forming a pile surface on one face of said backing, said strips each including a condensed base portion portion secured to said backing and a pair of uncondensed leg portions connected to said base portion and extending from the surface of said backing.

3. A pile fabric according to claim 2 or 1 wherein said fabric strips are comprised of a woven textile fabric.

4. A pile fabric according to claim 3 wherein said woven fabric strips are cut on the bias.

5. A pile fabric according to claim 2 or 1 wherein each of the fabric strips are of a predetermined uniform color throughout the rug.

6. A pile fabric according to claim 2 or 1 wherein certain of the fabric strips are of a different color from other fabric strips in the rug to form a multicolor appearance in the rug.

7. A pile fabric according to claim 2 or 1 wherein at least some of the fabric strips have printed patterns thereon.

8. A pile fabric according to claim 2 or 1 including a back coating carried by the opposite face of said backing and also serving to anchor said base portion to said backing.

9. A method of producing a tufted fabric comprising providing elongate fabric strips, forming said strips into a condensed strand configuration, tufting the strips into a backing layer to form a base portion penetrating the backing and a loop portion extending therefrom, and severing the loop portion to form a pair of cut pile tufts extending from the backing fabric while allowing the tufts to unfurl into a generally uncondensed strip-like configuration.

10. A method according to claim 9 wherein the step of forming the strips into a condensed strand configuration comprises twisting the strips.

11. A method according to claim 9 including the additional step of applying a back coating to the back face of the backing to anchor the tufts to the backing.

* * * * *